US005857906A

United States Patent [19]

Cho

[11] Patent Number: 5,857,906

[45] Date of Patent: Jan. 12, 1999

[54] METHODS AND APPARATUS FOR CONTROLLING THE DIRECTION AND FLOW RATE OF AIR DISCHARGED FROM AN AIR CONDITIONER

[75] Inventor: Jae-Seok Cho, Seoul, Rep. of Korea

[73] Assignee: Samsung Electronics Co., Ltd., Suwon, Rep. of Korea

[21] Appl. No.: 861,996

[22] Filed: May 22, 1997

[30] Foreign Application Priority Data

| | | | |
|---|---|---|---|
| May 22, 1996 | [KR] | Rep. of Korea | 1996 17545 |
| May 22, 1996 | [KR] | Rep. of Korea | 1996 17546 |
| May 22, 1996 | [KR] | Rep. of Korea | 1996 17547 |
| May 22, 1996 | [KR] | Rep. of Korea | 1996 17548 |
| May 22, 1996 | [KR] | Rep. of Korea | 1996 17549 |

[51] Int. Cl.[6] ..... G05D 23/00; F24F 7/007

[52] U.S. Cl. ..... 454/229; 236/493; 236/51

[58] Field of Search ..... 236/49.3, 51, 91; 454/256, 229

[56] References Cited

U.S. PATENT DOCUMENTS

| | | | |
|---|---|---|---|
| 5,326,028 | 7/1994 | Kano et al. | 236/51 X |
| 5,637,040 | 6/1997 | Kim et al. | 454/256 |

FOREIGN PATENT DOCUMENTS

| | | | |
|---|---|---|---|
| 2260830 | 4/1993 | United Kingdom | 454/256 |

*Primary Examiner*—William Wayner
*Attorney, Agent, or Firm*—Burns, Doane, Swecker & Mathis, L.L.P.

[57] ABSTRACT

An air conditioner discharges air through an air outlet and into a room. The direction of the discharged air is controlled by adjusting horizontal and/or vertical blades extending across the air outlet. The air flow rate can be controlled by adjusting a variable speed fan. Infrared sensors detect human bodies in the room and determine a distance and direction of the bodies with respect to the air conditioner for controlling the blades and fan in order to supply air to a region(s) of the room in which a human body is detected.

4 Claims, 9 Drawing Sheets

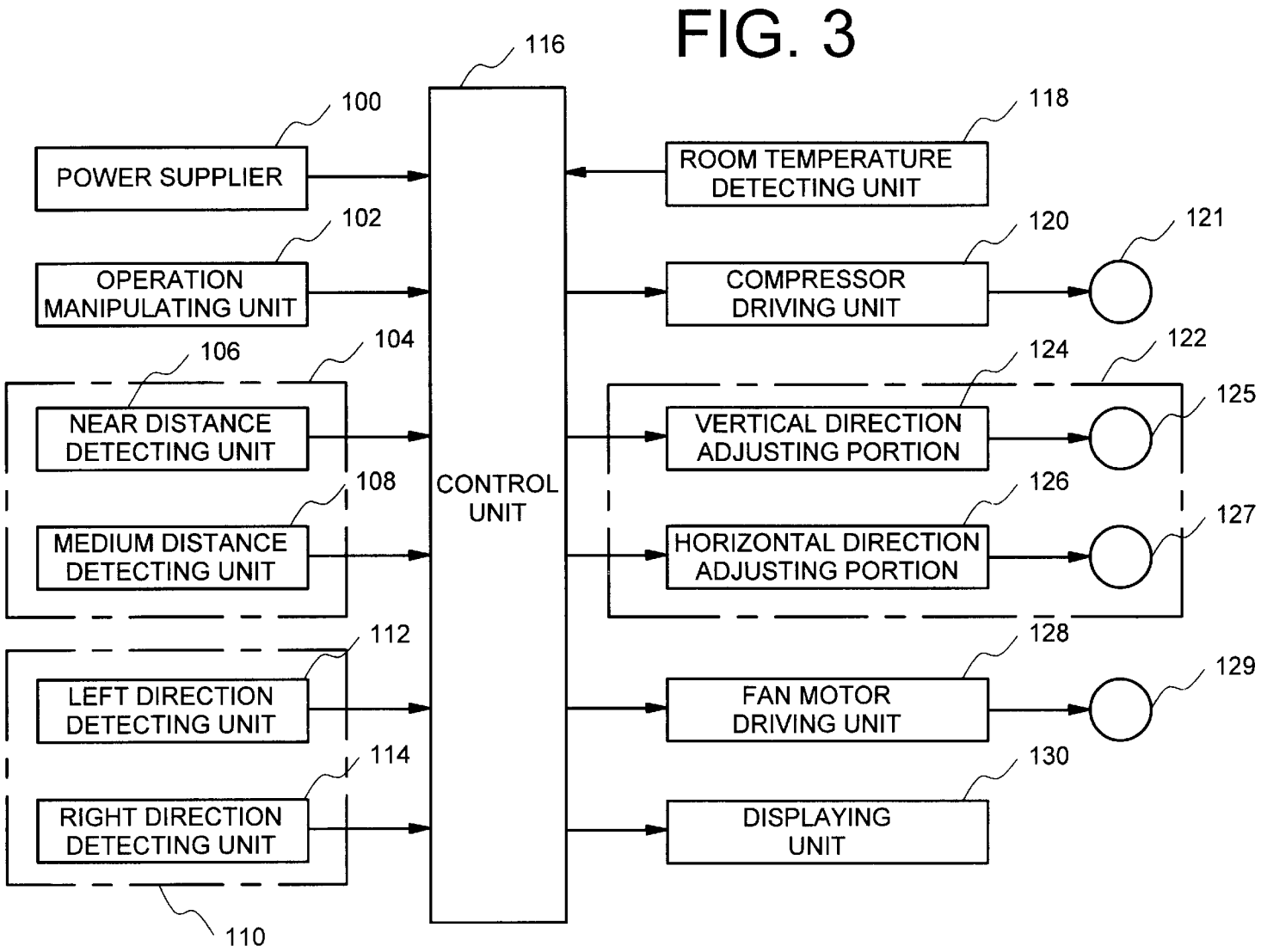
FIG. 3
POWER SUPPLIER
OPERATION MANIPULATING UNIT
NEAR DISTANCE DETECTING UNIT
MEDIUM DISTANCE DETECTING UNIT
LEFT DIRECTION DETECTING UNIT
RIGHT DIRECTION DETECTING UNIT
CONTROL UNIT
ROOM TEMPERATURE DETECTING UNIT
COMPRESSOR DRIVING UNIT
VERTICAL DIRECTION ADJUSTING PORTION
HORIZONTAL DIRECTION ADJUSTING PORTION
FAN MOTOR DRIVING UNIT
DISPLAYING UNIT
100
102
104
106
108
110
112
114
116
118
120
121
122
124
125
126
127
128
129
130

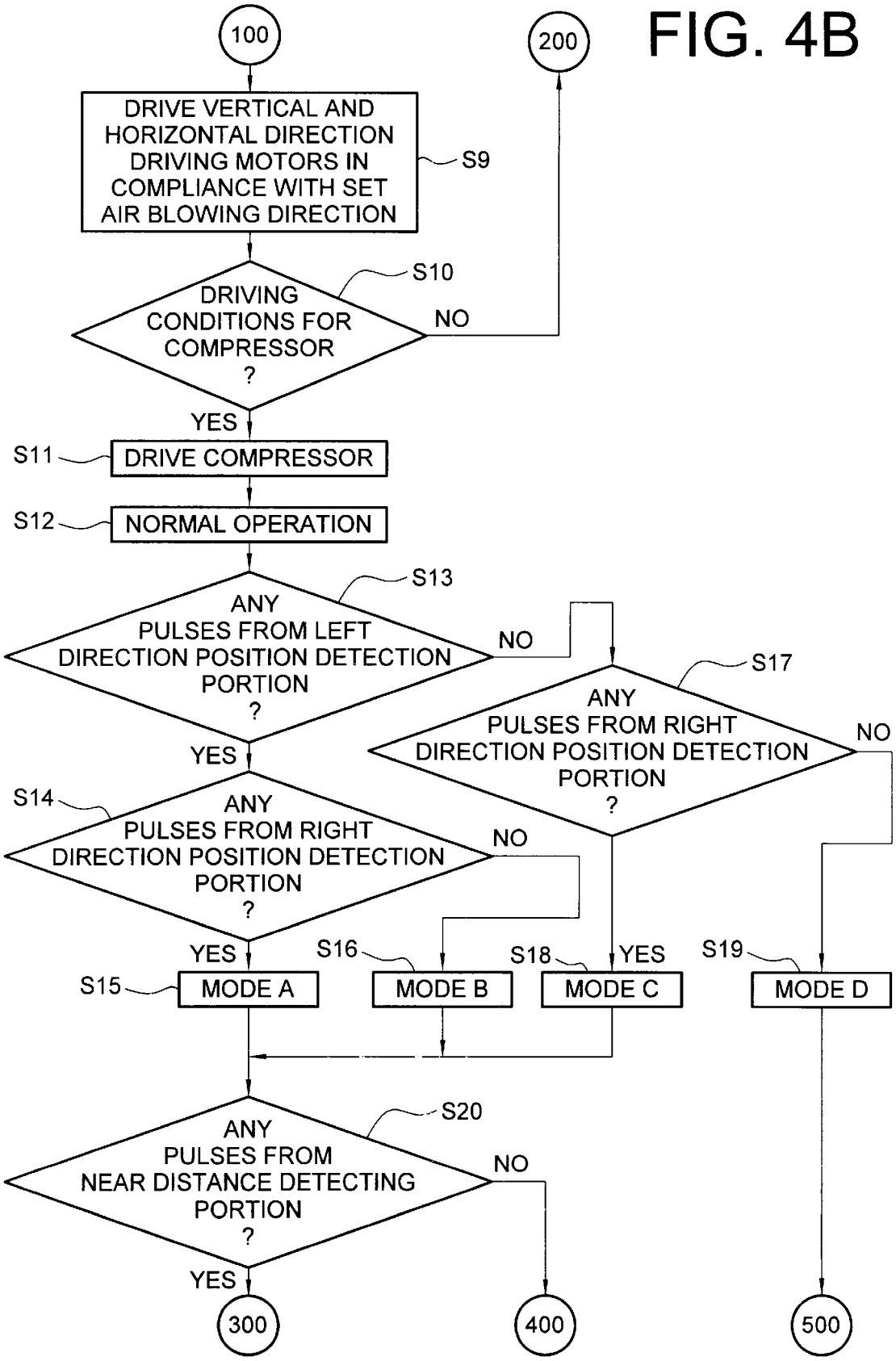
FIG. 4B
100
200
DRIVE VERTICAL AND HORIZONTAL DIRECTION DRIVING MOTORS IN COMPLIANCE WITH SET AIR BLOWING DIRECTION
S9
S10
DRIVING CONDITIONS FOR COMPRESSOR ?
NO
YES
S11
DRIVE COMPRESSOR
S12
NORMAL OPERATION
S13
ANY PULSES FROM LEFT DIRECTION POSITION DETECTION PORTION ?
NO
YES
S17
ANY PULSES FROM RIGHT DIRECTION POSITION DETECTION PORTION ?
NO
S14
ANY PULSES FROM RIGHT DIRECTION POSITION DETECTION PORTION ?
NO
YES
S16
S18
YES
S19
S15
MODE A
MODE B
MODE C
MODE D
S20
ANY PULSES FROM NEAR DISTANCE DETECTING PORTION ?
NO
YES
300
400
500

METHODS AND APPARATUS FOR CONTROLLING THE DIRECTION AND FLOW RATE OF AIR DISCHARGED FROM AN AIR CONDITIONER

BACKGROUND OF THE INVENTION

1. Field of the Invention

The present Invention relates to discharging air current control methods and apparatus for a room air conditioner.

2. Description of the Prior Art

A conventional air conditioner has, as shown in FIG. 1, a suction grille member 5 provided at a front lower portion of the main body 1 including suction inlets 3 for admitting room air, and a discharge outlet 7 for discharging indoors the air heat-exchanged (warmed or cooled) by a heat-exchanger, the outlet 7 disposed at a front upper portion of the body 1.

Vertical and horizontal sets of blades 11 and 9 extend across the discharge outlet 7 for use in adjusting the respective vertical and horizontal directions in which the heat-exchanged air is discharged indoors through the discharge outlet 7. A cover member 13 attached to the front surface of the body 1 is used in protecting the interior of the body 1 and is usually designed to give a good appearance thereto. In a lower area of the cover member 13 is disposed a manipulating portion in the form of a control panel 15 for selecting desired operation modes of the air conditioner such as automatic mode, cooling, heating, defrost, air-cleaning, and so forth, and a start/stop of the air conditioner, and also for adjusting the amount or flow directions of the air discharged through the discharge outlet 7.

As shown in FIG. 2, filter member 17 is installed adjacent an inner side of the suction grille member 5 for filtering-out foreign substances contained in the room air, and an oblong-shaped heat exchanger 19 is provided downstream of the filter member 17 such that the room air from the filter member 17 is thermally exchanged with cold or warm refrigerant by the evaporation latent heat of the refrigerant.

Over the heat exchanger 19 is disposed a blower fan 23 (hereinafter also referred to as an indoor fan) which is rotated in response to the driving of an indoor fan motor 21, for sucking the room air through the suction inlet 3 and also discharging indoors the heat-exchanged air through the discharging outlet 7. Around the indoor fan 40 is installed a duct member 25 to guide the airflow from the suction inlet 3 to the discharge outlet 7 and also to serve as a protection for the indoor fan 23.

In the conventional air conditioner thus constructed, if a user selects a desired operational mode through either a remote controller or the operation manipulating portion 15, and then depresses an operation key, the indoor fan 23 is rotated such that the room air is sucked into the body 1 through the suction inlet 3.

The sucked air passes through the filter member 17 for filtering-out any foreign substances such as dust entrained in the room air. The cleaned air is then heat-exchanged by the evaporating latent heat of the refrigerant flowing in the heat-exchanger 19 when the sucked air passes across the heat-exchanger 19.

The air heat-exchanged by the heat-exchanger 19 is guided into an upper portion of the body 1 by the duct member 25 and then discharged indoors through the discharge outlet 7 in a direction determined according to adjustments of the vertical and horizontal blades 11, 9 for accomplishing the conditioning of the room air.

In controlling the vertical and horizontal flow directions established by the vertical and horizontal blades 11, 9 the position of horizontal blades 9 is adjusted each time a key on the operation manipulating portion 15 is actuated, and the blades 9 are not moved any longer when the key is turned off. Similarly, the position of the vertical blades 11 is varied each time another key is actuated, and the blades 11 are not moved any longer when that key is turned off.

However, this manipulation is inconvenient in that a user has to visually confirm the respective positions of both sets of blades 9, 11 to verify that a desired pattern of an air current has been set. Furthermore, there are problems in that the air is discharged only in directions which are vertically or horizontally set, depending upon the given angles of the blades 9, 11, resulting in a somewhat narrow range of air flow, and further, an air speed and distance to which the discharged air can be delivered cannot be easily controlled.

Further, to condition the entire room, it is necessary to re-adjust the angles of the blades 9, 11 at predetermined time intervals, and in order to air condition remote areas of the room an increase in the speed of the discharging air may be needed. This burdens a user with the need for making periodic adjustments of the air blowing direction, as well as the air speed.

SUMMARY OF THE INVENTION

Therefore, it is an object of the present invention to provide an air flow control methods and apparatus, by which an improved convenience for use of the air conditioner is provided in that the direction and flow rate of discharged air can automatically be set based upon the presence, location and proximity of a human body, so that an air-conditioning throughout the room can be made, and a comfortable environment can be provided.

The above objects are accomplished by an air conditioner comprising a body forming an air inlet for receiving air from a room, a heat exchanger disposed in the body for exchanging heat with the air, an air outlet formed by the body for discharging the heat-exchanged air into the room, air-directing blades disposed across the air outlet for controlling a flow direction of the air being discharged, a motor-driven blade-adjusting mechanism disposed in the body for adjusting an orientation of the blades for varying the flow direction, a variable speed fan disposed in the body for circulating air from the inlet to the outlet and across the heat exchanger, and an air flow control apparatus disposed on the body. The air flow control apparatus comprises a distance determining mechanism, a position determining mechanism, and a control mechanism. The distance determining mechanism detects infrared radiation emanating from a human body in the room and determines therefrom a distance from the human body to the air conditioner. The position determining mechanism detects infrared radiation emanating from a human body in the room and determining therefrom a general direction of the human body from the air conditioner body. The control mechanism is connected to the distance determining mechanism, the position determining mechanism, the variable speed fan, and the blade-adjusting mechanism, for controlling a direction and flow rate of the discharged air to supply discharged air to a region of the room in which a human body is detected.

The present invention also relates to a method of controlling a flow direction of air discharged from an air outlet of an air conditioner into a room. The method comprises the steps of detecting infrared radiation emanating from a human body in the room and determining therefrom a general direction and distance of the human body relative to the air conditioner, and controlling a flow direction and flow rate of the discharged air to direct the discharged air to a region of the room in which a human body is detected.

The method preferably also includes the step of displaying operating conditions of the air conditioner.

Another method aspect of the invention involves a method of controlling a flow direction of air discharged from an air outlet of an air conditioner into a room. The method comprises the steps of detecting infrared radiation emanating from a human body in the room and determining a distance and direction of the human body with respect to the air conditioner, and adjusting an air directing mechanism disposed across the air outlet for supplying air to a region of the room in which a human body is detected. The adjusting step includes directing the air forwardly and downwardly when a human body is detected as being within a reference distance from the air conditioner, and directing the air forwardly upwardly when a human body is detected as being beyond the reference distance.

The method preferably further includes the step of continually oscillating the air directing mechanism to displace the air within a vertical angle when human bodies are detected as being within and beyond the reference distance, respectively.

BRIEF DESCRIPTION OF THE DRAWINGS

Other objects and aspects of the invention will become apparent from the following description of embodiments with reference to the accompanying drawings in which:

FIG. 3 is a control block diagram of a discharging air current control apparatus for controlling the air conditioner according to the present invention;

DETAILED DESCRIPTION OF THE PREFERRED EMBODIMENT

Figure 1:
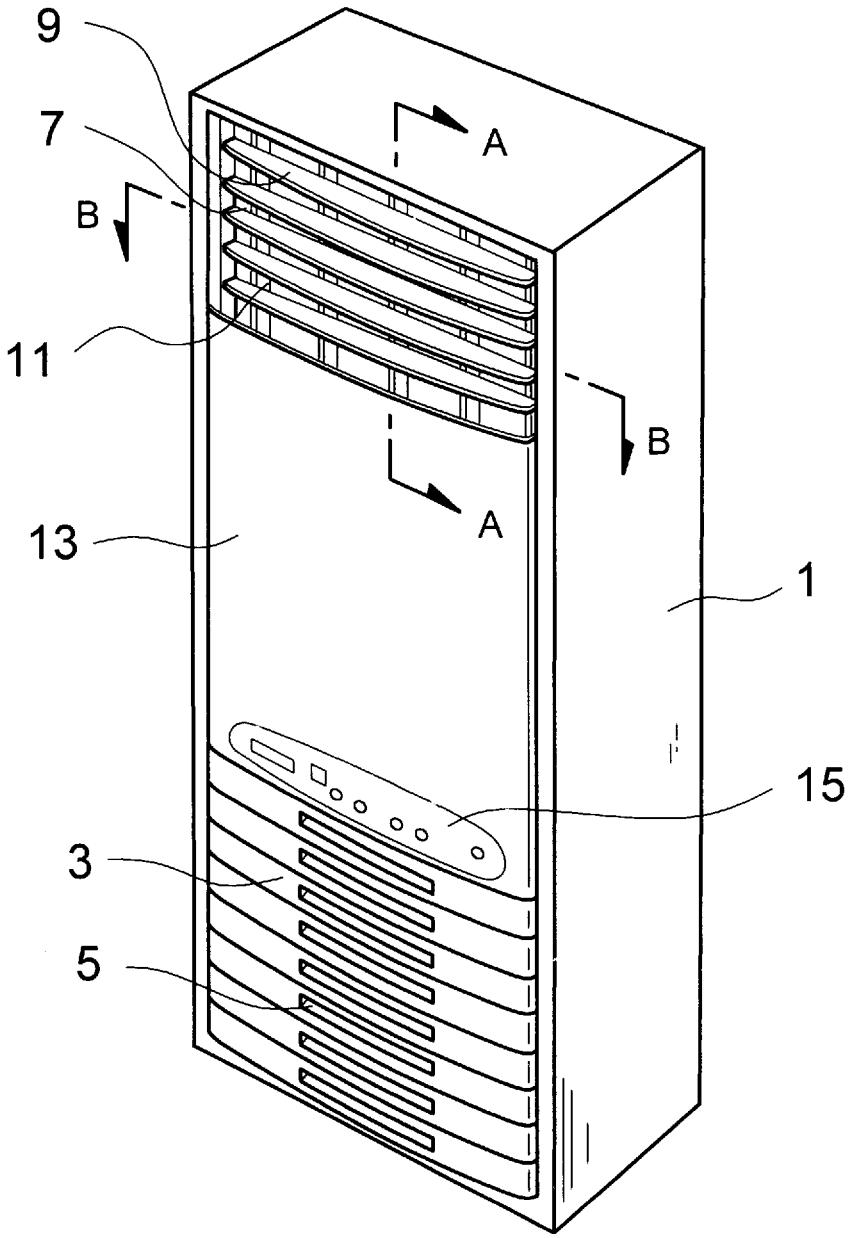
FIG. 1 (PRIOR ART)
FIG. 1 is a perspective view of a conventional air conditioner.

The preferred embodiment of the present invention will now be described in detail in accordance with the accompanying drawings.

Throughout the accompanying drawings, like parts are designated by like reference numerals or symbols.

Figure 2:
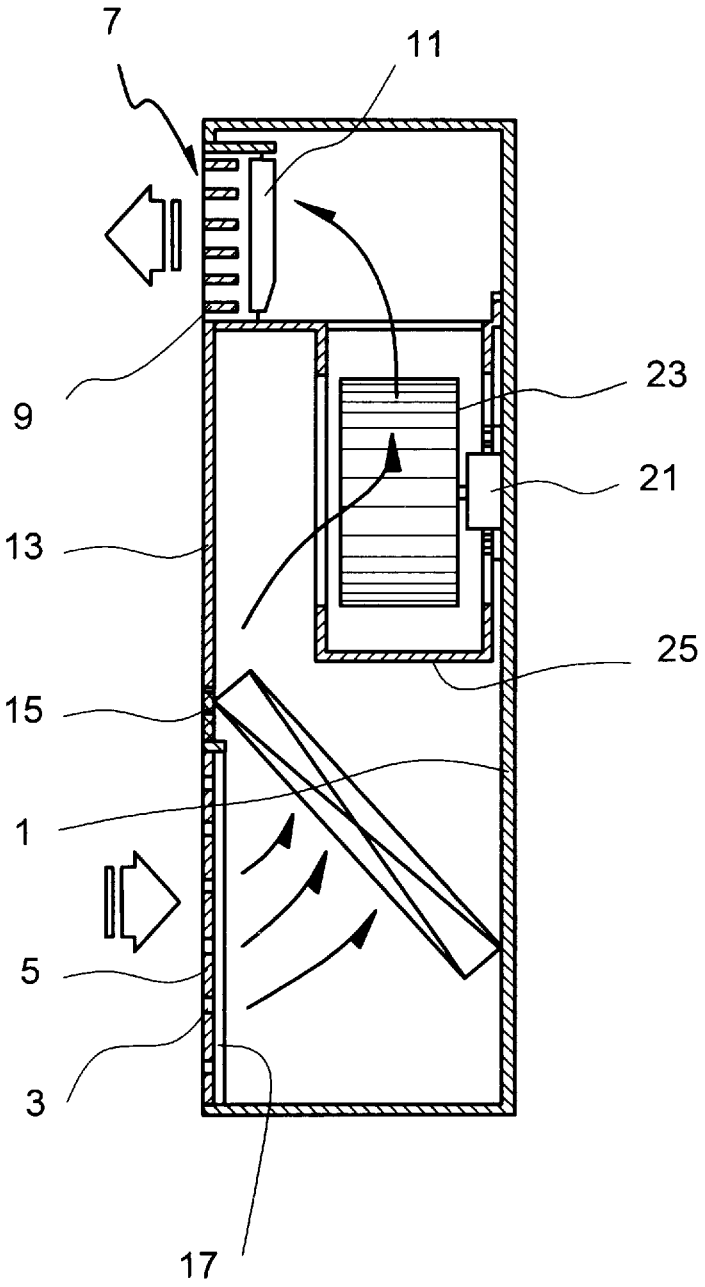
FIG. 2 (PRIOR ART)
FIG. 2 is a vertical sectional view of the conventional air conditioner.

As shown in FIG. 3, power supply means 100 receiving a commercial AC voltage fed from an AC source converts the AC voltage into a predetermined level of a DC voltage required to activate the air conditioner, and outputs the DC voltage. Operation manipulating means 102 is provided with many function keys for directing the desired operation modes of the air conditioner depicted in FIGS. 1 and 2 such as automatic mode, cooling, heating, defrost, air-cleaning, and so forth, and a start/stop of the air conditioner, as well as for setting a desired temperature of the room and the or flow directions of the air to be discharged.

Korean Application Serial No. P97-8013, or alternatively in U.S. Ser. No. 08/800,559, the disclosures of which are incorporated herein by reference.

Distance detecting means 104, which may be substantially an infrared sensor directed toward the room sensor, is provided for acquiring, based upon the detection of infrared rays emanating from the human body, a distance information as to how far the human body is spaced from the air conditioner body 1. The infrared sensor has two cells for detecting human bodies at different distances, respectively, of which one cell 106 (hereinafter, called CELL#1, a near distance detecting unit) is for near (proximate) distance detection within a range of 2 m, and another cell 108 (hereinafter, called CELL#2, a medium distance detecting unit) is for medium distance detection within a range of 4 m.

Position detecting means 110 is provided for detecting, based upon the detection of infrared rays from the human body, the direction of the existing human body relative to the body 1. The detecting means 110 is substantially an infrared sensor consisting of two cells, of which one cell 112 (hereinafter, called as CELL#1, a left direction detecting unit) detects human bodies in the leftward direction, and another cell 114 (hereinafter, called as CELL#2, a right direction detecting unit) detects human bodies in the rightward direction.

Control means 116 receives a DC voltage supplied from the power supply means 100 and initializes the air conditioner operation. The control means 116 substantially comprises a microcomputer for controlling the general operations of the air conditioner in compliance with the selected operations and start/stop signals which are input at the operation manipulating means 102. This control means 116 controls, based upon the distance to the human body sensed by the distance detecting means 104 and a left or right of the human body sensed by the position detecting means 110, the air blowing angles of the blades 9, 11, and the revolution speed of the indoor fan 23 and a set temperature Ts so as to result in the supply of the heat-exchanged air to an overall room.

Room temperature detecting means 118 senses a temperature Tr of room air sucked through the suction inlet 3 to conduct the air-conditioning operation in compliance with the temperature Ts set by a user. Compressor driving means 120 receives a control signal output from the control means 116 in response to the difference between the temperatures Ts and Tr, and drives a compressor 121.

Figure 6A:
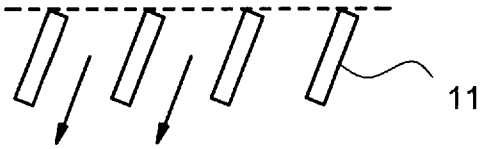
FIGS. 6A–6C show various operational positions of vertical blades as seen along line B—B in FIG. 1.

Air blowing direction adjusting means 122 is provided for adjusting the discharged air flow direction based upon the distance to the human body sensed by the distance detecting means 104 and a left or right position of the human body sensed by the position detecting means 110 so as to result in the supply of the heat-exchanged air to an overall room. This air blowing direction adjusting means 122 includes a vertical direction adjusting portion 124 which receives a control signal from the control means 116 and drives a vertical direction driving motor 125 to rotate the blades 9 vertically (i.e., up or down), As will be explained, the horizontal blades 9 can be adjusted to a desired position and then stopped or they can be continuously oscillated up and down within a selected angle. A horizontal direction driving portion 126 receives a control signal from the control means 116 and drives a horizontal direction driving motor 127 to rotate the vertical blades 11 to a fixed position selected from: a neutral position (FIG. 6B), a leftward directed position inclined from the neutral position by a predetermined angle of about 15 degrees (FIG. 6C), or a rightward directed position also by a predetermined angle of about 15-degrees (FIG. 6A).

Fan motor driving means 128 is provided for controlling the amount of discharged air flow based upon a distance to the human body sensed by the distance detecting means 104 and a left or right position of the human body sensed by the position detecting means 110 so as to result in the supply of the heat-exchanged air to an overall room. Thus, the means 128 controls the revolution speed of the indoor fan motor 21 to drive the fan 23 in response a control signal from the control means 116, for the purpose of blowing indoors the heat-exchanged air in compliance with an air blowing amount selected by the operation manipulating means 102.

Display means 130 receives a control signal which is output from the control means 116 in response to a key input signal from the operation manipulation means 102, and then displays the selected operation modes of the air conditioner such as automatic mode, cooling, heating, defrost, air-cleaning, and so forth, and the set temperature and the sensed temperature. Further, the display means 130 turns on or off a near-distance indicating lamp representing a near-distance(FOCUS) operation mode for conditioning a space near to the body 1, a wide indicating lamp for a wide (WIDE) operation condition for conditioning an overall room, and a wave indicating lamp representing a wave (WAVE) operation condition for conditioning the middle portion of the room.

The operation and advantages of an air current controlling apparatus for an air conditioner thus constructed, and a method associated therewith will be discussed below.

Figure 4A:
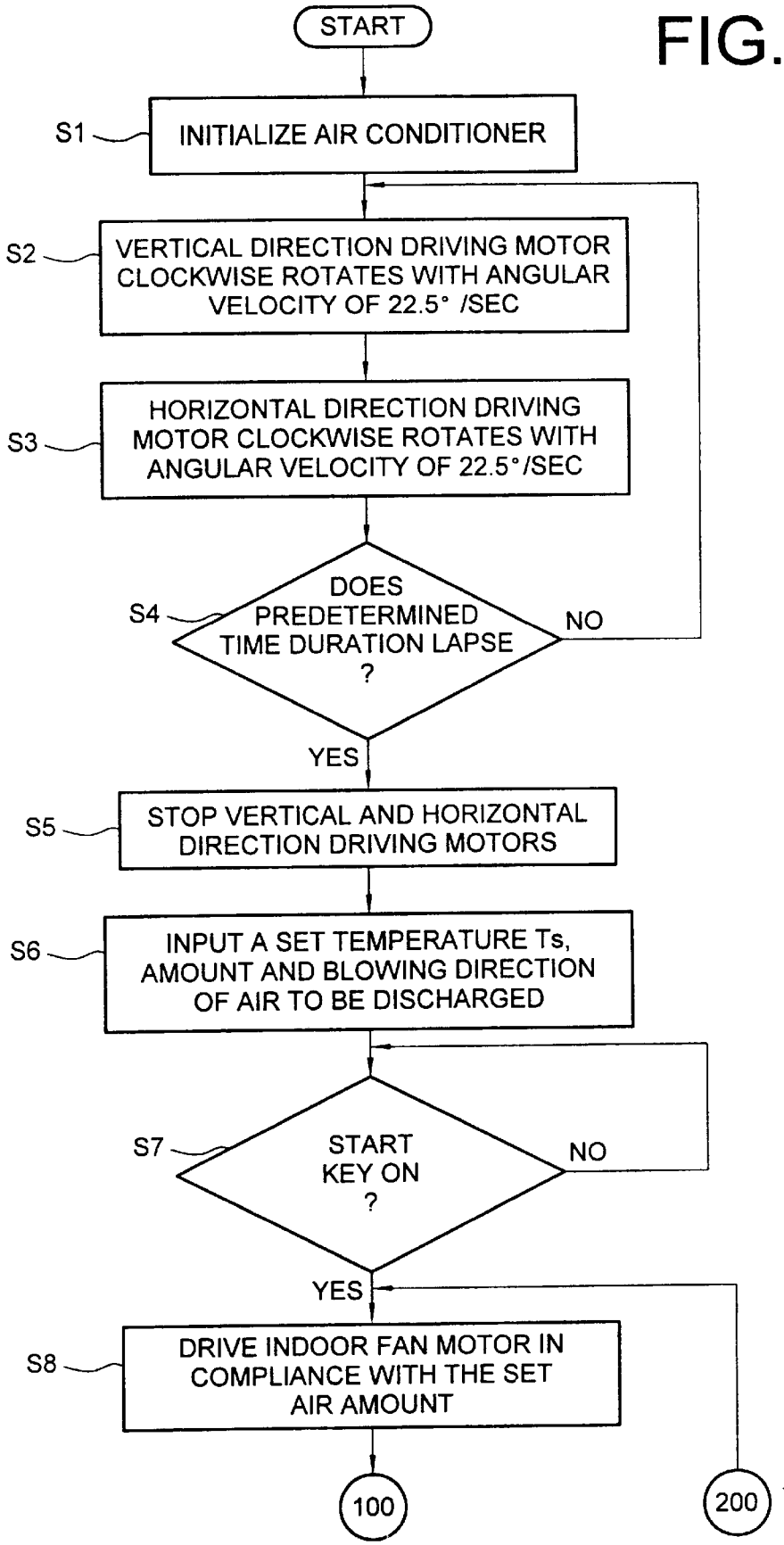
FIG. 4 is a flow chart illustrating sequential control procedures for a discharging air current control.
Figure 4C:
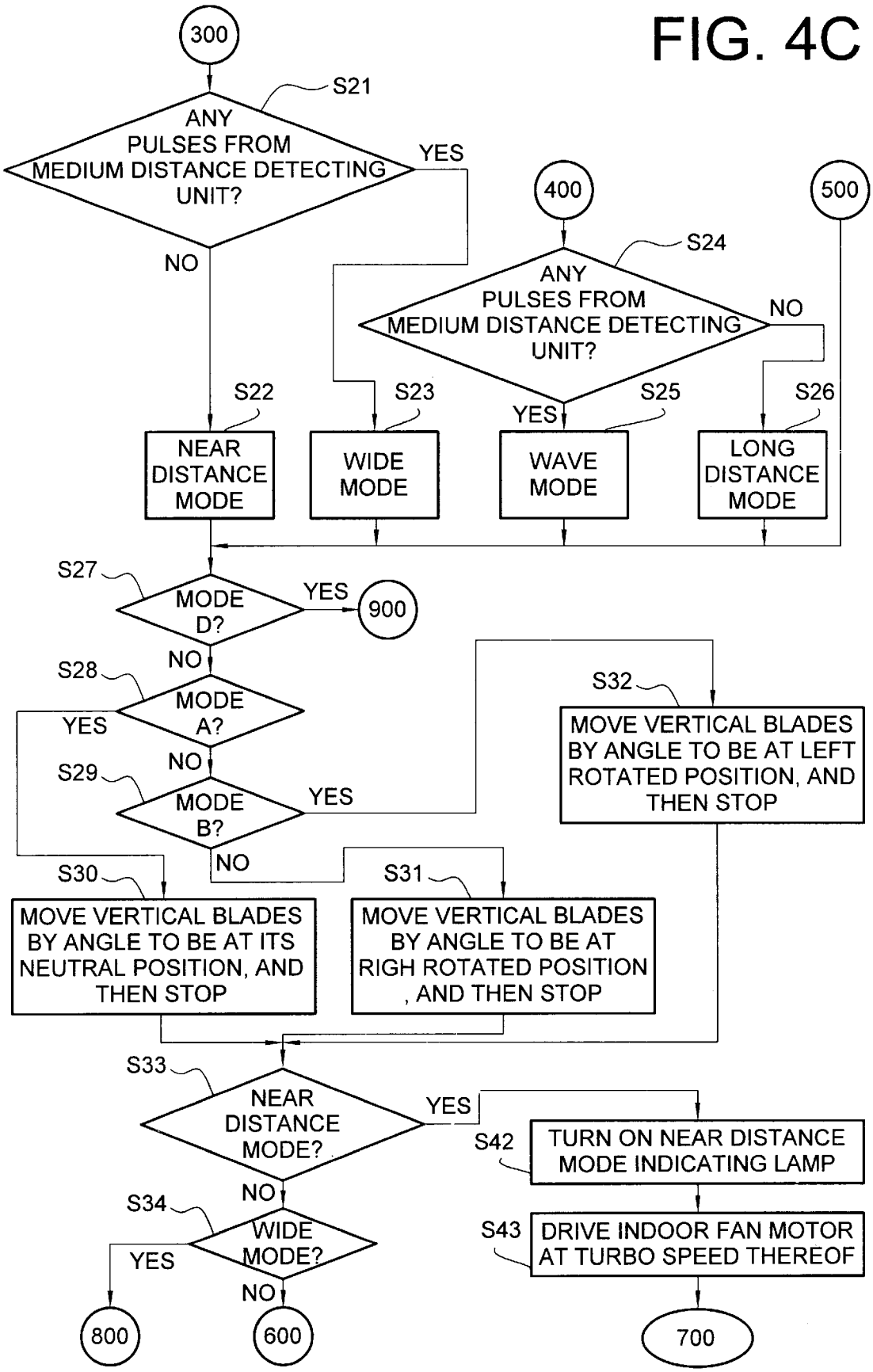
Figure 4D:
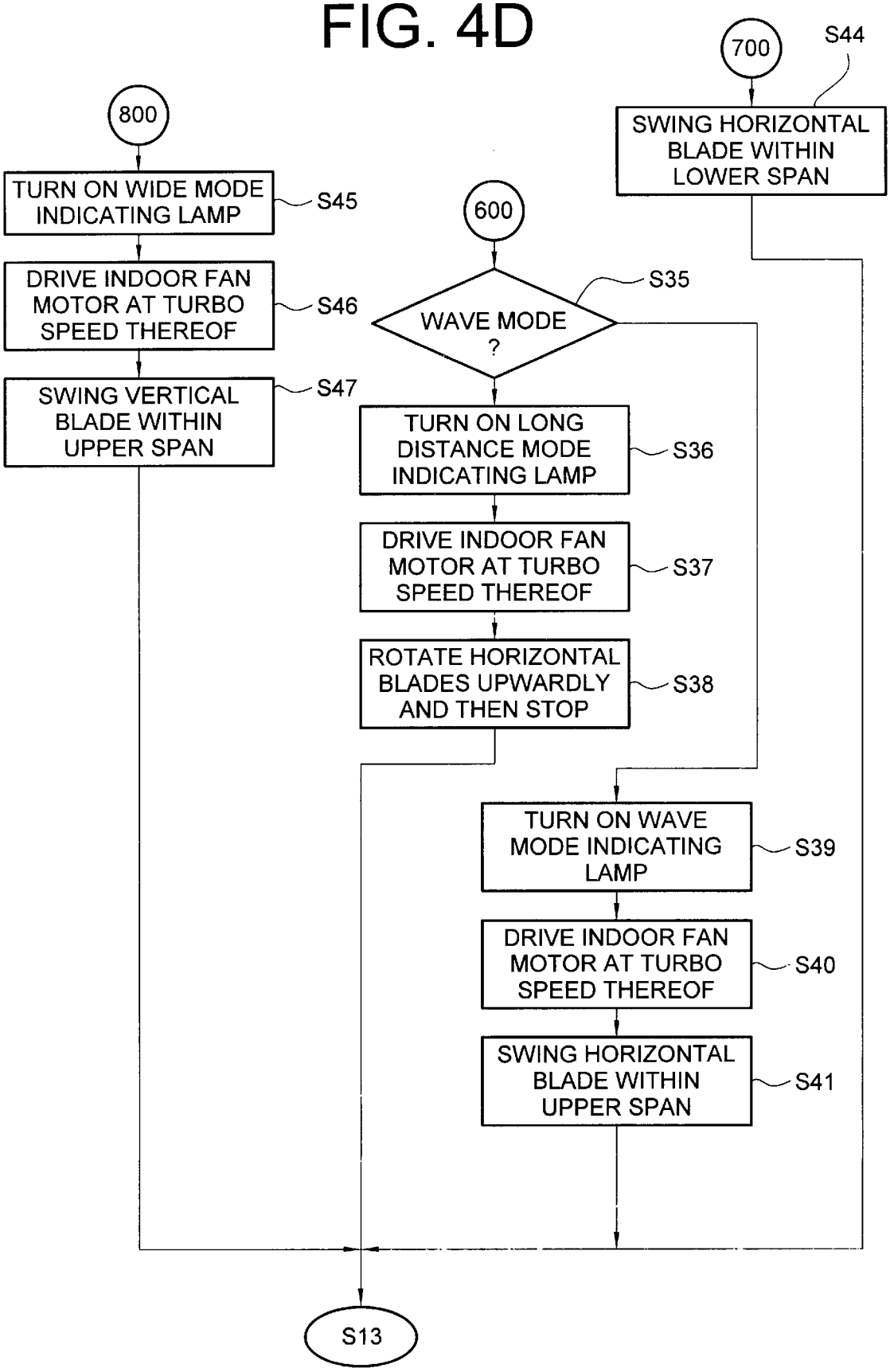
Figure 4E:
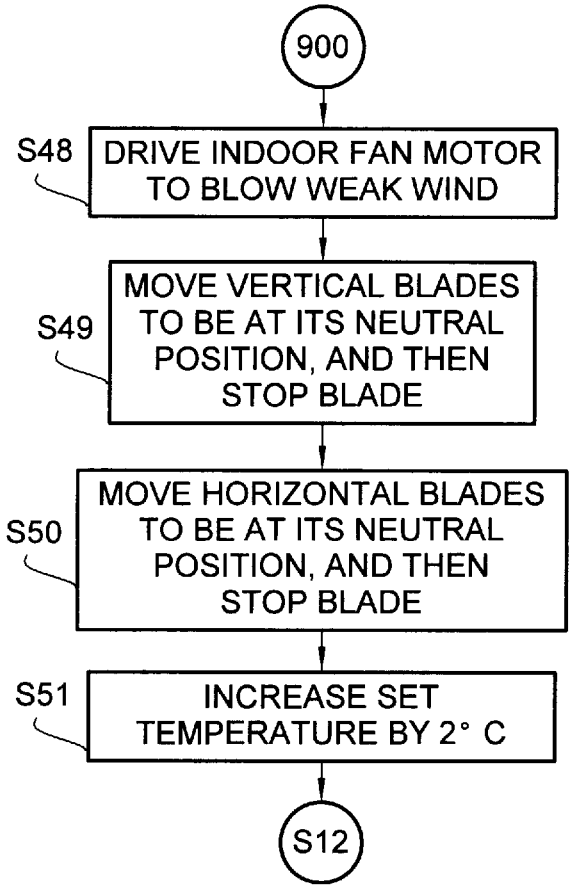

FIGS. 4A and 4E are flow charts illustrating the sequential processing steps 51–S51 for controlling an air current for an air conditioner according to the present invention.

As an electric power is applied to the air conditioner, the control means 116 receives a DC voltage supplied from the power supply means 100 and initializes the air conditioner (S1). A control signal for driving the vertical direction driving motor 125 from the control means 116 is then applied to the vertical direction adjusting portion 124 to return the horizontal blades 9 to their initial, closed state. That is, the vertical direction driving motor 125 driven by the vertical direction adjusting portion 124 rotates clockwise with an angular velocity of 22.5-degree/sec, consequently closing the horizontal blades 9(S2).

At step S3, the control means 116 outputs to the horizontal direction adjusting portion 126 a control signal for driving a horizontal direction driving motor 127 to return the vertical blades 11 to their initial, closed state. That is, the horizontal direction driving motor 127 driven by the horizontal direction adjusting portion 126 rotates clockwise with an angular velocity of 22.5-degree/sec, which closes the vertical blades 11.

At step S4, the control means 116 counts a predetermined driving duration such as about 7 seconds for the vertical and horizontal direction driving motors 125, 127. Till the lapse of the predetermined time duration, the steps following step S2 are repeated for completing the closing of both sets of blades 9, 11.

After the lapse of the defined time duration, which implies that both sets of blades 9, 11 have been completely closed, the process goes to step S5 where the vertical and horizontal direction adjusting portions 124, 126 stop both motors 125, 127 under the control of the control means 116 at the completion of the closing operation for both blades 9, 11, wherein this condition will be used as an initial state hereinafter.

The initialization routines from step S2 to S5 are performed for completely closing both blades 9, 11 each time that the air conditioner is turned on, since it is difficult to make an accurate positional control if the blade positions were changed due to an external (e.g., manual) manipulation thereof while the air conditioner was off.

Next, at step S6, a desired room temperature Ts for cooling or heating the room, and an amount and blowing direction of the air to be discharged are set at the control means 116 through the operation manipulating means 102. At step S7, it is determined if the start key is on.

Upon the start key being on, the manipulating commands and operating signals from the operation manipulating means 102 are input to the control means 116 which then outputs a control signal to the fan motor driving means 128.

Thus, the fan motor driving means 128 receives the control signal issued from the control means 116 based upon the air amount previously set and drives the indoor fan 23 with a controlled speed of the indoor fan motor 21 (S8).

When the driven indoor fan 23 sucks the room air into the body 1, the room temperature detecting means 118 senses a temperature Tr of the room air sucked through the suction inlet 3 and outputs the result to the control means 116.

Next, at step S9, the control means 116 outputs a control signal to the vertical and horizontal direction adjusting portions 124, 126 for driving the vertical and horizontal direction driving motors 125, 127 so as to adjust the directional angles of the respective blades 9, 11 for guiding the air in compliance with the set air blowing direction.

At step S10, the comparison is made between the room temperature Tr sensed by the room temperature detecting means 118 and the set temperature Ts in order to determine if the respective driving conditions of cooling and heating for the compressor 121 are met. The compressor under a cooling operation is driven when the sensed temperature Tr is higher than the set temperature Ts, and vice versa for a heating operation.

The detection of the room temperature Tr at step S10 continues until the driving condition for the compressor 121 is met, i.e., until the compressor driving means 120 receives a control signal for driving the compressor 121 from the control means 116 which decides the operation frequency for the compressor 121 based upon the difference between the room temperature Tr and the set temperature Ts.

As the driven indoor fan 23 sucks the room air into the body 1 through the suction inlet 3, the sucked air passes through the filter member 17 for filtering out any foreign substances such as dust contained in the room air. The cleaned air is then heat-exchanged by the evaporating latent heat of the refrigerant flowing in the heat-exchanger when the sucked air passes across the heat-exchanger.

The heat-exchanged air is guided to an upper portion of the air conditioner by the duct member 25, and the air blowing direction of the guided air is based upon the set angles of the vertical and horizontal blades 11, 9 disposed at the discharging outlet 7.

The foregoing describes a normal operation of the air conditioner. During such a normal operation, it is determined if input pulses are present which are generated from the left direction position detection portion 112 of the position detecting means 110 that senses infrared rays from the human body (step S13). The left direction position detecting portion 112 outputs pulses only when a motion of the human body is sensed.

If the input pulses are present(in case of YES), the process advances to step S14 in which it is determined if input pulses are present which are generated from the right direction position detection portion 114 of the position detecting means 110 that senses infrared rays from the human body.

The right position detection portion 114 outputs the pulses only when a motion of the human body is sensed. Then, the process goes to step S15 where an operational mode A of the air conditioner is set by the control means 116. An absence of pluses from the right direction position detection portion 114 indicates that a motion of the human body occurs only in a left-hand zone in front of the air conditioner, and therefore, advancing to step S16, an operational mode B of the air conditioner is set by the control means 116.

Again, at step S13, when there are no pulses from the left direction detection portion 112(in case of NO), the process advances to step S17 where it is determined whether or not any pulses from the right direction detecting portion 114 are output, and if so(in case of YES), it can be determined that motion of the human body occurs only in a right-hand zone in front of the body 1, followed by step S18 where an operational mode C of the air conditioner is set by the control means 116.

At step S17, when there are no pulses from the right direction detection portion 114(in case of NO), it can be determined that no motion of the human body is occurring at either of the front-right and front-left zones of the body 1, followed by step S19 where an operational mode D of the air conditioner is set by the control means 116.

Next, to know if the human body is at a near distance within 2 m, the process checks whether input pulses are output from the near distance detecting unit 106 of the distance detecting means 104. If so(in case of YES), the process goes to step S21 where it is checked whether the human body is at a medium distance within 4 m by determining whether or not input pulses are output from the medium distance detecting unit 108 of the distance detecting means 104.

At step S21, when there are no pulses from the medium distance detecting unit 108(in case of NO), it is determined that motion of the a man body is occurring at a place near to the body 1, followed by step S22 where a near distance mode of the air conditioner is set by the control means 116. Also, when there are pulses from the medium distance detecting unit 108 at step S21 (in case of YES), it is determined that motions of a human body are occurring near to, and at a medium distance from, the body 1, followed by step S23 where a wide mode of operation of the air conditioner is set by the control means 116.

Again, at step S20, when there are no pulses from the near distance detecting unit 106(in case of NO), the process advances to step S24 where it is determined if any pulses are output from the medium distance detecting unit 108, and if so(in case YES), it is determined that the motion of the human body occurs at a medium distance from the body 1, followed by step S25 where a WAVE mode of operation of the air conditioner is set by the control means 116.

Figure 6B:
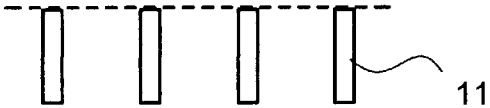

At step S24, if there are no pulses from the medium distance detecting unit 108(in case of NO), the process advances to step S26 where a long distance mode of operation of the air conditioner is set by the control means 116, Next, at step S27, it is determined if the operational mode is currently set as mode D, and if not(in case of NO), the process advances to step S28 which checks whether or not the current mode is set as mode A. If it is determined as being mode A(in case of YES), the process goes to step S30 where the horizontal direction adjusting portion 126 drives the horizontal direction driving motor 127 such that the vertical blades 11 are moved by a predetermined angle to be the neutral position, as shown in FIG. 6(B), and then stops.

Figure 6C:
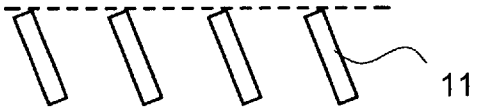

At step S28, if the current operational mode is not set as mode A(in case of NO), it is checked whether or not the current mode is set as mode B at step S29. If it is determined as being not B mode(in case of NO), the current mode is determined as being mode C, and then the process goes to step S31 where the horizontal direction adjusting portion 126 under the control of the control means 116 drives the motor 127 such that the vertical blades 11 are moved by a predetermined horizontal angle(about 15 degrees) to a rightward directed position as shown in FIG. 6(C), and then stops.

At step S29, if the current operational mode is determined as being mode B (in case of YES), the process goes to step S32 where the horizontal direction adjusting portion 126 drives the motor 127 such that the vertical blades 11 are moved by a predetermined horizontal angle(about 15 degrees) to be at a leftward directed position as shown in FIG. 6(A), and then stops.

Next, at step S33, it is determined if the operational mode is currently set as the near distance mode, and if not(in case of NO), the process advances to step S34 to check whether or not the current mode is set as the wide mode. If it is determined as being not the wide mode (in case of NO), the process goes to step S35 where it is again determined if the current mode is set as the wave mode.

At step S35, if the current operational mode is determined as being not the wave mode(in case of NO), it is concluded that the current operational mode is the long distance mode. Accordingly, the process goes to step S36 where the display means 130 under the control of the control means 116 turns on the long distance indicating lamp representing the current operational condition as being the long distance mode, followed by step S37 where the fan motor driving means 128 receives a control signal from the control means 116 and drives the indoor fan motor 21 at a turbo speed (about 670 RPM).

Figure 5E:
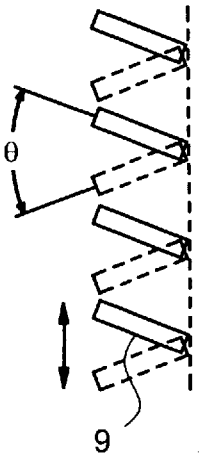
FIGS. 5A–5E show various operating positions of horizontal blades as seen along line A–A in FIG. 1.
Figure 5D:
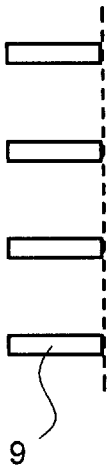

Then, at step S38, the control means 116 outputs a control signal to the vertical direction adjusting portion 124 so as to result in a projecting of the discharging air by a long distance. That is, the vertical direction adjusting portion 124 drives the vertical direction driving motor 125, such that as shown in FIG. 5A, the horizontal blades 9 are rotated upwards by a predetermined angle of about 15 degrees and then are stopped.

Thus, the room air taken in through the suction inlet 3 is heat-exchanged by the evaporating latent heat of the refrigerant flowing in the heat-exchanger, and guided by the duct member 25 to the upper portion of the air conditioner, where the air under the long distance mode is guided by the stationary upwardly rotated blades 9(Fig. SA), and the vertical blades 11 previously set in one of the positions shown in 6A–6C. Returning to step S13, the process continues to repeat the subsequent steps.

Again, at step S35, if the current operational mode is determined as being the wave mode(in case of YES), the process goes to step S39 where the display means 130 under the control of the control means 116 displays the detected wave operation state of the air conditioner through the turned on indicating lamp, followed by step S40 where the fan motor driving means 128 receives a control signal from the control means 116 and drives the indoor fan motor 21 at the turbo speed. Then, at step S41, the control means 116 outputs a control signal to the vertical direction adjusting portions 124 so as to result in a projecting of the discharging air to a middle area in the room.

Figure 5C:
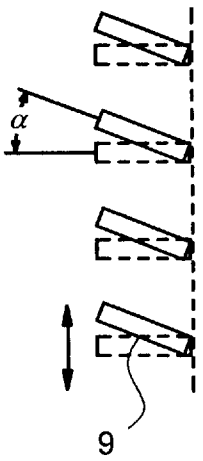

Accordingly, the vertical direction adjusting portion 124 drives the vertical direction driving motor 125, such that as shown in FIG. 5C, the vertical blade 9 is continuously oscillated within a generally upwardly directed vertical angle of about 15 degrees.

Thus, the room air taken in through the suction inlet 3 is heat-exchanged by the evaporating latent heat of the refrigerant flowing in the heat-exchanger, and guided by the duct member 25 to the upper portion of the air conditioner, where the air is delivered to the middle area of the room by the oscillation of the horizontal blades 9 and the previously set position of the vertical blades 11 in one of the right, left, or center positions. Returning to step S13, the process continues to repeat the subsequent steps.

Also, at step S33, if the current operational mode is determined as being the near-distance mode(in case of YES), the process goes to step S42 where the display means 130 under the control of the control means 116 displays the detected near-distance operation state of the air conditioner by turning on the near-distance mode indicating lamp, followed by step S43 where the fan motor driving means 128 receives a control signal from the control means 116 and drives the indoor fan motor 21 at the turbo speed.

Figure 5B:
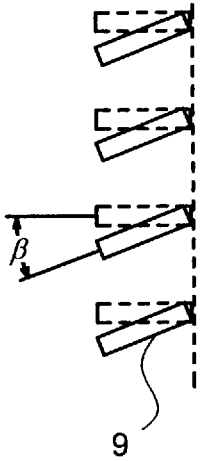
Figure 5A:
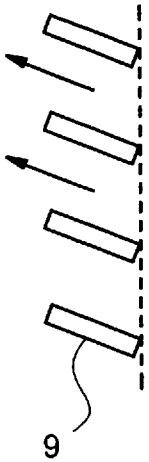

Then, at step S44, the control means 116 outputs a control signal to the vertical direction adjusting portions 124 so as to result in a projecting of the discharging air by a short distance from the body 1. That is the vertical direction adjusting portion 124 drives the vertical direction driving motor 125, such that as shown in Fig. 5B, the horizontal blades 9 are continuously oscillated within a generally downwardly directed vertical angle β of about 15 degrees.

Thus, the room air taken in through the suction inlet 3 is heat-exchanged by the evaporating latent heat of the refrigerant flowing in the heat-exchanger, and guided by the duct member 25 to the upper portion of the air conditioner, where the air is directed near to the body 1 by the oscillation of the horizontal blades 9 and the previously set position of the vertical blades 11 in one of the right, left, or center positions. Returning to step S13, the process continues to repeat the subsequent steps.

At step S34, if the current operational mode is determined as the wide mode(in case of YES), the process goes to step S45 where the display means 130 under the control of the control means 116 displays the detected wide operational mode of the air conditioner by turning on the wide mode indicating lamp, followed by step S46 where the fan motor driving means 128 receives a control signal from the control means 116 and drives the indoor fan motor 21 at the turbo speed.

Then, at step S47, the control means 116 outputs a control signal to the vertical direction adjusting portion 124 so as to result in a distribution of the discharging air throughout the room. That is, the vertical direction adjusting portion 124 drives the vertical direction driving motor 125, such that as shown in FIG. 5E, the horizontal blades 9 are continuously oscillated up and down within a vertical angle θ of about 30 degrees.

Thus, the room air taken in through the suction inlet 3 is heat-exchanged by the evaporating latent heat of the refrigerant flowing in the heat-exchanger, and guided by the duct member 25 to the upper portion of the air conditioner, where the air is directed to the middle area of the room by the oscillation of the horizontal blades 9 and the previously set position of the vertical blades 11 in the right, left, or center positions. Returning to step S13, the process continues to repeat the subsequent steps.

At step S27, if the current operational mode is determined as being mode D(in case of YES), the process goes to step S48(see FIG. 4E) where the fan motor driving means 128 in response to a control signal from the control means 116 controls the revolution speed of the indoor fan motor 21 for establishing a weak air flow from the indoor fan, and then at step S49, the control means 116 outputs a control signal to the horizontal direction adjusting portions 126 so as to adjust an angle of the 11.

That is, the horizontal direction adjusting portion 126 in response to a control signal from the control means 116 drives the horizontal direction driving motor 127, such that as shown in FIG. 6B, the vertical blades 11 are centrally or neutrally positioned by rotating those blades 11 through a given angle, and then stopping the rotation.

At step S50, the control means 116 outputs a control signal to the vertical direction adjusting portion 124 for adjusting an angle of the horizontal blades 9.

Receiving a control signal from the control means 116, the vertical direction adjusting portion 124 drives the vertical direction driving motor 125 such that as shown in FIG. 5D, the horizontal blades 9 are rotated to a central position. After that, the drive for the vertical motor 125 is stopped. At step S51, the temperature Ts set by a user is increased by 2 degrees C., and then the process is returned to step S12 for normal operation, followed by the repeat of the subsequent steps.

According to the present invention, an improved convenience for use of the air conditioner is provided in that the directions, air speed and a set temperature can automatically be set based upon the presence, location and proximity of a human body. An air-conditioning throughout the room can be made, so that comfortable conditions can be provided.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. An air conditioner comprising a body forming an air inlet for receiving air from a room, a heat exchanger disposed in the body for exchanging heat with the air, an air outlet formed by the body for discharging the heat-exchanged air into the room, vertical and horizontal air-directing blades disposed across the air outlet for controlling a flow direction of the air being discharged, a motor-driven blade-adjusting mechanism disposed in the body for adjusting an orientation of the vertical and horizontal blades for varying the air flow direction, a variable speed fan disposed in the body for circulating air from the inlet to the outlet and across the heat exchanger, and an air flow control apparatus disposed on the body comprising:

a distance determining mechanism consisting of two infrared cells for detecting infrared radiation emanating from a human body in the room at first and second distances, respectively, from the body, the second distance being greater than the first distance, and determining therefrom a distance from the human body to the air conditioner body;

a position determining mechanism consisting of two additional infrared cells for detecting infrared radiation emanating from a human body at right and left sides, respectively, of the room and determining therefrom a general direction of the human body from the air conditioner body; and a control mechanism connected to the distance determining mechanism, the position determining mechanism, the variable speed fan and the blade-adjusting mechanism, for controlling the direction and flow rate of the discharged air to supply air to a region of the room in which a human body is detected, the control mechanism operable to selectively establish a wave mode in which the horizontal blades oscillate within a first angle extending substantially above horizontal, a wide mode in which the horizontal blades oscillate within a second angle extending above and below horizontal, the second angle being greater than the first angle, and a near-distance mode in which the horizontal blades oscillate within a third angle extending substantially below horizontal; and display means for illuminating one of three lamps for indicating that one of the wave mode, wide mode, and near-distance mode has been established.

2. The air conditioner according to claim 1 wherein the position determining mechanism is operable to supply a signal to the control mechanism when a human body is in motion.

3. A method of controlling a flow direction of air discharged from an air outlet of an air conditioner into a room, the method utilizing a body forming an air inlet for receiving air from a room, a heat exchanger disposed in the body for exchanging heat with the air, an air outlet formed by the body for discharging the heat-exchanged air into the room, vertical and horizontal air-directing blades disposed across the air outlet for controlling a flow direction of the air being discharged, a motor-driven blade-adjusting mechanism disposed in the body for adjusting an orientation of the vertical and horizontal blades for varying the air flow direction, and a variable speed fan disposed in the body for circulating air from the inlet to the outlet and across the heat exchanger, the method comprising the steps of:

A) detecting infrared radiation emanating from a human body in the room and determining a distance and direction of the human body with respect to the air conditioner;

B) actuating the fan to draw air from the room and across the heat exchanger, and discharge the air back into the room through the air outlet; and C) actuating the blade-adjusting mechanism during step B for supplying air to a region of the room in which a human body is detected, including:

C1) directing the air generally forwardly and downwardly when a human body is detected as being within a reference distance from the air conditioner by oscillating the horizontal blades up and down within an angle of about 15 degrees extending substantially below horizontal; and C2) directing the air generally forwardly and upwardly when a human body is detected as being beyond the reference distance by positioning the horizontal blades at an angle of about 15 degrees extending substantially above horizontal and holding the blades in that position.

4. The method according to claim 3 further including the step of displaying operating conditions of the air conditioner.

* * * * *